US011098713B2

(12) United States Patent
Staedele et al.

(10) Patent No.: US 11,098,713 B2
(45) Date of Patent: Aug. 24, 2021

(54) PUMP

(71) Applicant: Watson Marlow GmbH, Rommerskirchen (DE)

(72) Inventors: Achim Staedele, Unterheinriet (DE); Eric Mayer, Heilbronn (DE)

(73) Assignee: Watson Marlow GmbH, Rommerskirchen (DE)

( * ) Notice: Subject to any disclaimer, the term of this patent is extended or adjusted under 35 U.S.C. 154(b) by 241 days.

(21) Appl. No.: 15/763,426

(22) PCT Filed: Sep. 29, 2016

(86) PCT No.: PCT/EP2016/073337
§ 371 (c)(1),
(2) Date: Mar. 26, 2018

(87) PCT Pub. No.: WO2017/055497
PCT Pub. Date: Apr. 6, 2017

(65) Prior Publication Data

US 2018/0306183 A1 Oct. 25, 2018

(30) Foreign Application Priority Data

Oct. 2, 2015 (DE) ..... 102015116768.9

(51) Int. Cl.
*F03C 2/00* (2006.01)
*F03C 4/00* (2006.01)
(Continued)

(52) U.S. Cl.
CPC ..... *F04C 2/3568* (2013.01); *F01C 21/10* (2013.01); *F04C 15/06* (2013.01);
(Continued)

(58) Field of Classification Search
CPC .... F04C 2/3568; F04C 14/04; F04C 15/0042; F04C 2240/20; F04C 2240/30;
(Continued)

(56) References Cited

U.S. PATENT DOCUMENTS 1,690,727 A 11/1928 Jaworowski
1,690,728 A * 11/1928 Jaworowski ..... F04C 2/3568 418/216
(Continued)

FOREIGN PATENT DOCUMENTS

EP 1637740 A1 3/2006
EP 2565454 A1 3/2013
(Continued)

OTHER PUBLICATIONS

International Search Report for Application PCT/EP2016/073337 dated Dec. 22, 2016.
(Continued)

*Primary Examiner* — Theresa Trieu
(74) *Attorney, Agent, or Firm* — Honigman LLP

(57) ABSTRACT

A pump includes a rotor and a pump housing. The rotor is rotatable about a rotation axis and comprises a rotor hub and a rotor collar. The rotor collar extends from the rotor hub in the radial direction and encircles the rotor hub in an undulating manner. The pump housing comprises a first axial housing component, a central annular housing component, and a second axial housing component. A pump duct is formed (i) in the axial direction by the first and second housing components and (ii) in the radial direction by the central annular housing component and the rotor.

18 Claims, 8 Drawing Sheets

(51) Int. Cl.

| | |
|---|---|
| ***F04C 18/00*** | (2006.01) |
| ***F04C 2/00*** | (2006.01) |
| ***F04C 2/356*** | (2006.01) |
| ***F01C 21/10*** | (2006.01) |
| ***F04C 15/06*** | (2006.01) |

(52) U.S. Cl.
CPC ..... *F04C 2240/20* (2013.01); *F04C 2240/30* (2013.01); *F04C 2250/10* (2013.01); *F05C 2201/90* (2013.01)

(58) Field of Classification Search
CPC ..... F04C 15/06; F04C 2250/10; F04C 2250/101; F04C 2250/102; F01C 21/0809; F01C 21/10; F05C 2201/90
USPC ..... 418/125, 127, 152, 178–179, 216–217, 418/221–223, 228–229, 242–243, 219
See application file for complete search history.

(56) References Cited

U.S. PATENT DOCUMENTS

| | | | | |
|---|---|---|---|---|
| 3,156,158 | A * | 11/1964 | Pamplin | F04C 2/3568 418/217 |
| 3,994,638 | A * | 11/1976 | Garland | F04C 2/3568 418/216 |
| 4,093,408 | A * | 6/1978 | Yamaguchi | F04C 2/3568 418/216 |
| 5,980,225 | A | 11/1999 | Sommer | |
| 2004/0105772 | A1* | 6/2004 | Lee | F04C 2/3568 418/216 |
| 2007/0292297 | A1* | 12/2007 | Fromm | F04C 2/3568 418/216 |
| 2008/0131298 | A1* | 6/2008 | Hyun | F04C 2/3568 418/219 |
| 2013/0209243 | A1 | 8/2013 | Fromm et al. | |

FOREIGN PATENT DOCUMENTS

| | | | |
|---|---|---|---|
| GB | 189913992 | A | 2/1900 |
| JP | S51-009925 | A | 1/1976 |
| JP | S519925 | B1 | 3/1976 |
| JP | S51-69206 | A | 6/1976 |
| JP | S55-3557 | A | 1/1980 |
| JP | H10-082396 | A | 3/1998 |
| JP | 2006144592 | A | 6/2006 |
| JP | 2008082218 | A | 4/2008 |
| JP | 2008-513664 | A | 5/2008 |
| WO | 2005066498 | A1 | 7/2005 |

OTHER PUBLICATIONS

Japanese Office Action for Application No. 2018-510455 dated Jan. 8, 2020, along with English translation.
German Examination Report for Application No. 102015116768.9 dated Jul. 7, 2016.
International Preliminary Report on Patentability for Application No. PCT/EP2016/073337 dated Apr. 3, 2018.
Chinese Office Action for Application No. 201680055624.0 dated Oct. 30, 2019 along with English translation.
Brazilian Office Action for Application BR112018003554-8 dated Jul. 6, 2020 (along with English translation).
Chinese Office Action for Application 201680055624.0 dated Jul. 9, 2020 (along with English translation).
Japanese Notice of Allowance for Application 2018-510455 dated Jun. 2, 2020 along with English Translation.
European Office Action for Application No. 1677965.1 dated Nov. 10, 2020.
German Examination Report for Application No. 102015116768.9 dated Feb. 19, 2021 along with English translation.
Japanese Office Action for Application 2018-510455 dated Oct. 1, 2019 (including English Translation).

* cited by examiner

PUMP

TECHNICAL FIELD

The invention relates to a pump having a rotor that is rotatable about a rotation axis and comprises a rotor hub and a rotor collar that extends from the rotor hub in the radial direction and encircles it in an undulating manner.

BACKGROUND

Such pumps are known as sinusoidal pumps. Provided in a pump housing made of metal are the rotor and plastic stators which form a pump duct that extends through an angular range of about 180° between an inlet formed in the pump housing and an outlet chamber, wherein the axial extreme points of the metal rotor collar each form a sealing line with the plastic stators. As a result of this design, the pump requires a relatively large amount of installation space and is complicated to assemble and disassemble in particular for cleaning or for maintenance.

SUMMARY

According to a first aspect of the invention, a pump comprises a rotor that is rotatable about a rotation axis and comprises a rotor hub and a rotor collar that extends from the rotor hub in the radial direction and encircles it in an undulating manner, and a pump housing which comprises a first axial housing component, a central annular housing component and a second axial housing component, wherein a pump duct is formed in the axial direction by the first and second housing components and in the radial direction by the central annular housing component and the rotor. In this way, the pump duct is formed by the pump housing and no plastic stators are required, with the result that the assembly and disassembly of the pump are easy to carry out and easy cleaning of the pump is allowed. The three-part configuration of the pump housing additionally allows a simple geometry of the housing components and thus cost-effective production of the pump housing.

According to a second aspect of the invention, a pump comprises a rotor that is rotatable about a rotation axis and comprises a rotor hub and a rotor collar that extends from the rotor hub in the radial direction and encircles it in an undulating manner, a pump housing which forms an annular pump duct with the rotor, said pump duct having a constant cross section and connecting a first radially external inlet/outlet space to a second radially external inlet/outlet space, and a blocking device which is arranged between the first radially external inlet/outlet space and the second radially external inlet/outlet space and which comprises a blocking element which blocks the pump duct in the axial direction on both sides of the rotor collar. As a result of the configuration of an annular pump duct with a constant cross section and a radial arrangement of the inlet/outlet spaces, the required installation space of the pump can be reduced. Furthermore, the angular range in which a fluid chamber closed by the rotor collar encircling in an undulating manner is formed can be increased in this way.

The seat for the blocking element can be formed in a chamber of the pump housing, wherein the chamber is formed in a sector of the annular pump duct and extends on both sides in the axial direction and outwards beyond the cross section of the annular pump duct in the radial direction. As a result of the formation of a separate chamber for the blocking element, the installation space required for the pump can be reduced. Furthermore, the chamber for the blocking element can be formed independently of the inlet/outlet chambers.

Preferably, the rotor collar of the rotor that encircles the latter in an undulating manner has flat end faces in the axial end positions. In this way, the sealing of the closed fluid chambers can be improved or a tolerance between the rotor and pump housing can be increased.

Preferably, the rotor and the pump housing are made of metal. This allows a robust configuration of the pump.

By way of example, the rotor and/or the housing can be made of an anti-seizure alloy. In this way, a metal-metal sealing contact between a metal housing and a metal rotor can be improved.

BRIEF DESCRIPTION OF THE DRAWINGS

Further features and advantages of the invention can be gathered from the following description and from the drawings to which reference is made. In the drawings.

DETAILED DESCRIPTION

Figure 1:
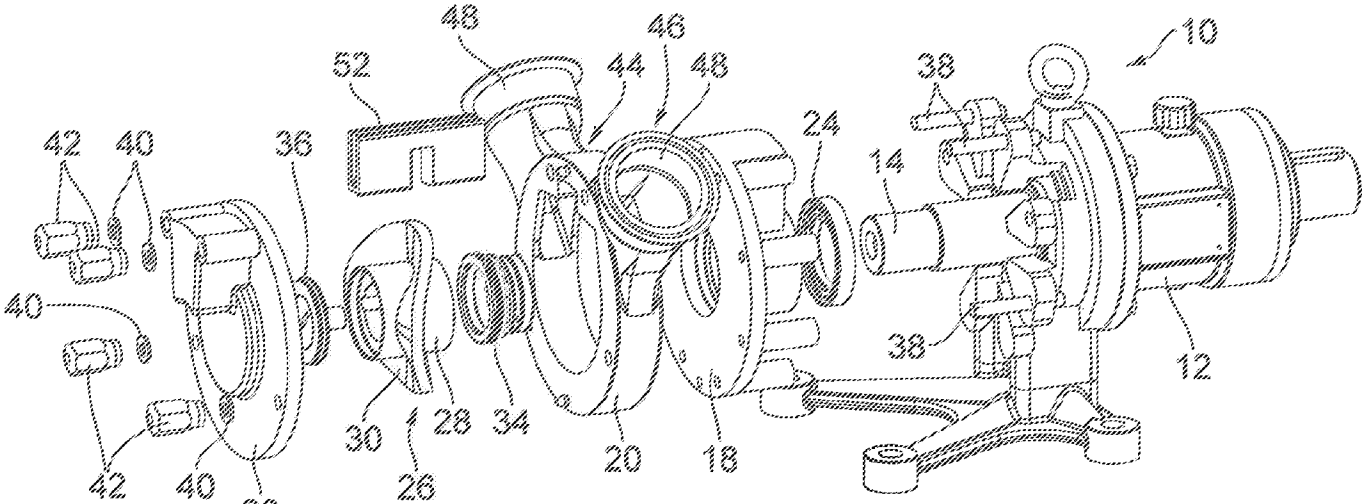
FIG. 1 shows a pump according to the invention in an exploded perspective view.
Figure 2:
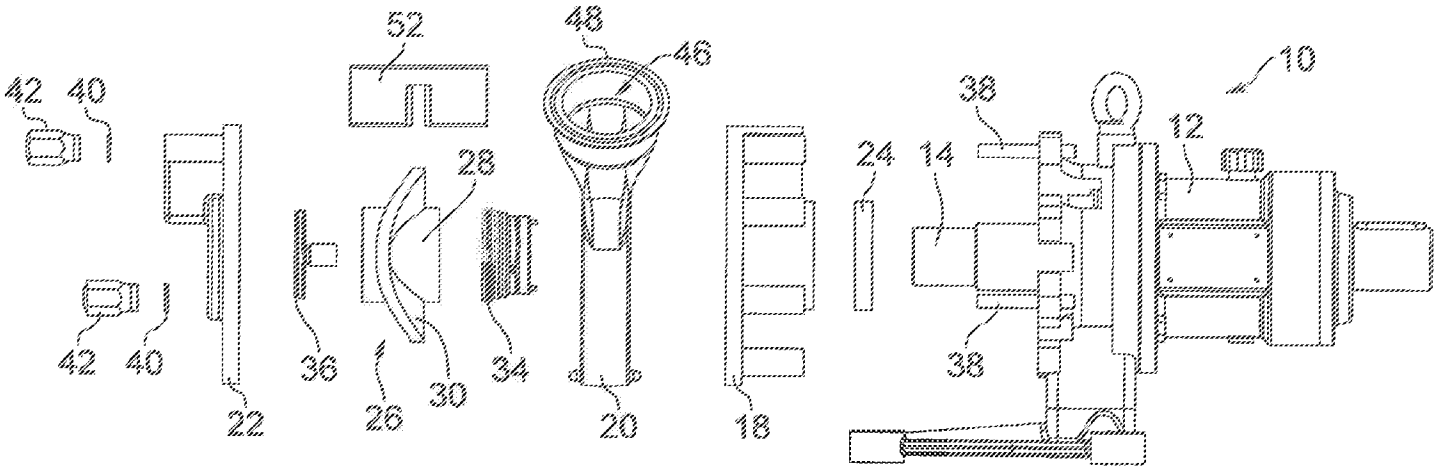
FIG. 2 shows the pump from FIG. 1 in an exploded side view.

FIGS. 1 and 2 each show a pump 10 in an exploded view. The pump 10 comprises a shaft mounting unit 12 which supports a shaft 14. Attached to the shaft mounting unit 12 is a pump housing 16 having a first axial housing component 18, a central annular housing component 20 and a second axial housing component 22.

Provided between the first axial housing component 18 and the shaft mounting unit 12 is a sealing element 24.

The shaft 14 projects into the pump housing 16 in a manner supported on one side. A rotor 26 comprises a rotor hub 28 and a rotor collar 30 that extends from the rotor hub 28 in the radial direction and encircles it in an undulating manner. The rotor 26 is fastened to the shaft 14 via a fastening bolt 36. The one-sided support allows a simple configuration of the pump housing 16, since it is in particular not necessary to support the shaft 14 in the second axial housing component 22.

In the following text, references to an axial direction relate to the rotation axis of the rotor 26 and references to a radial direction relate to a corresponding radial direction centered on the rotation axis. "Axially rearward" relates to the direction pointing towards the shaft mounting unit 12 and "axially forward" relates to the direction pointing towards the pump housing 16. The first axial housing component 18 is thus the axially rear housing component and the second axial housing component 22 is thus the axially front housing component.

Provided between the rotor 26 and the first axial housing component 18 is a mechanical face seal 34. Instead of the mechanical face seal, some other sealing element can also be provided.

The mounting of the shaft 14, the sealing element 24 and the mechanical face seal 34 and the fastening of the rotor 26 to the shaft 14 can also be configured in some other manner.

In the embodiment shown, the pump housing 16 is held together via four bolts 38, washers 40 and nuts 42, wherein the bolts 38 each extend from the shaft mounting unit 12 through all three housing components 18, 20, 22. However, some other fastening method can also be provided. For example, independent fastening of the housing components 18, 20, 22 to one another and of the pump housing 16 to the shaft mounting unit 12 can be provided or independent fastening of the second axial housing component 22 can be provided. This allows modular assembly and disassembly of the pump 10. Alternative ways of fastening the housing components 18, 20, 22 can also be provided. For example, the housing component 18 can be fastened to the shaft mounting unit 12 and the housing components 20 and 22 can be fastened to the housing component 18 via grub screws in the housing component 18.

The central annular housing component 20 has a first inlet/outlet space 44 and a second inlet/outlet space 46, which are each formed with a connection element 48 for connection to a pipeline.

A blocking device 50 comprises a blocking element 52 and is configured to block a pump duct in the axial direction on both sides of the rotor collar 30.

Figure 3:
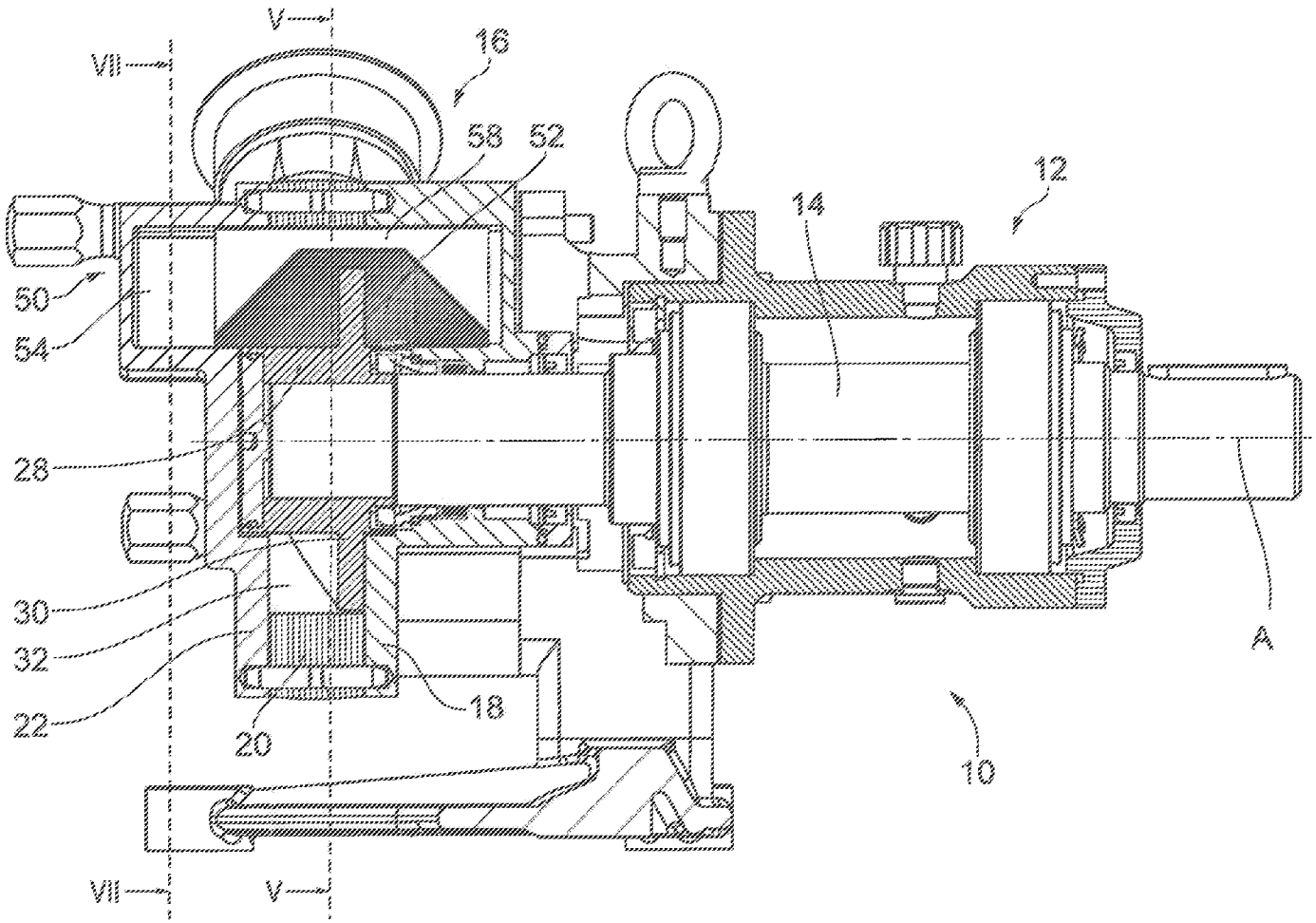
FIG. 3 shows a side view of the pump from FIG. 1 in the axial direction.

FIG. 3 shows the pump 10 in a sectional view on a section plane perpendicularly through the rotation axis A of the rotor 26 and the shaft 14. The housing components 18, 20 and 22 form a pump duct 32 together with the rotor hub 26, said pump duct 32 extending annularly around the rotor hub 26. The rotor collar 30 divides the pump duct 32 into various fluid chambers 55, wherein the radially outer end of the rotor collar adjoins the radial outer wall, formed by the annular housing component 18, of the pump duct 32 in a sealing manner.

The blocking device 50 is arranged in an upper sector, in the embodiment shown, of the pump duct 32. The blocking element 52 abuts in a sealing manner against the two axial side faces of the rotor collar 30 and against the rotor hub 28. When the rotor 26 is rotated, the blocking element 52 can move in the axial direction within a chamber 54 along the undulating shape of the rotor collar 30.

The chamber 54 is formed by the pump housing 16 and comprises a seat which forms the transition between the chamber 54 and the annular pump duct 32. The blocking element 52 abuts against the seat of the chamber 54 by way of a contacting face in every axial position and thus blocks the annular pump duct 32.

In the embodiment shown, the blocking element 52 has an exchange duct 58 which extends in the axial direction between an axially front fluid chamber and an axially rear fluid chamber on the opposite side of the rotor collar 30. The exchange duct 58 thus allows fluid to flow in the axial direction between the axially front fluid chamber and the axially rear fluid chamber. In this way, compression of the fluid during an axial movement of the blocking element is avoided.

Figure 4:
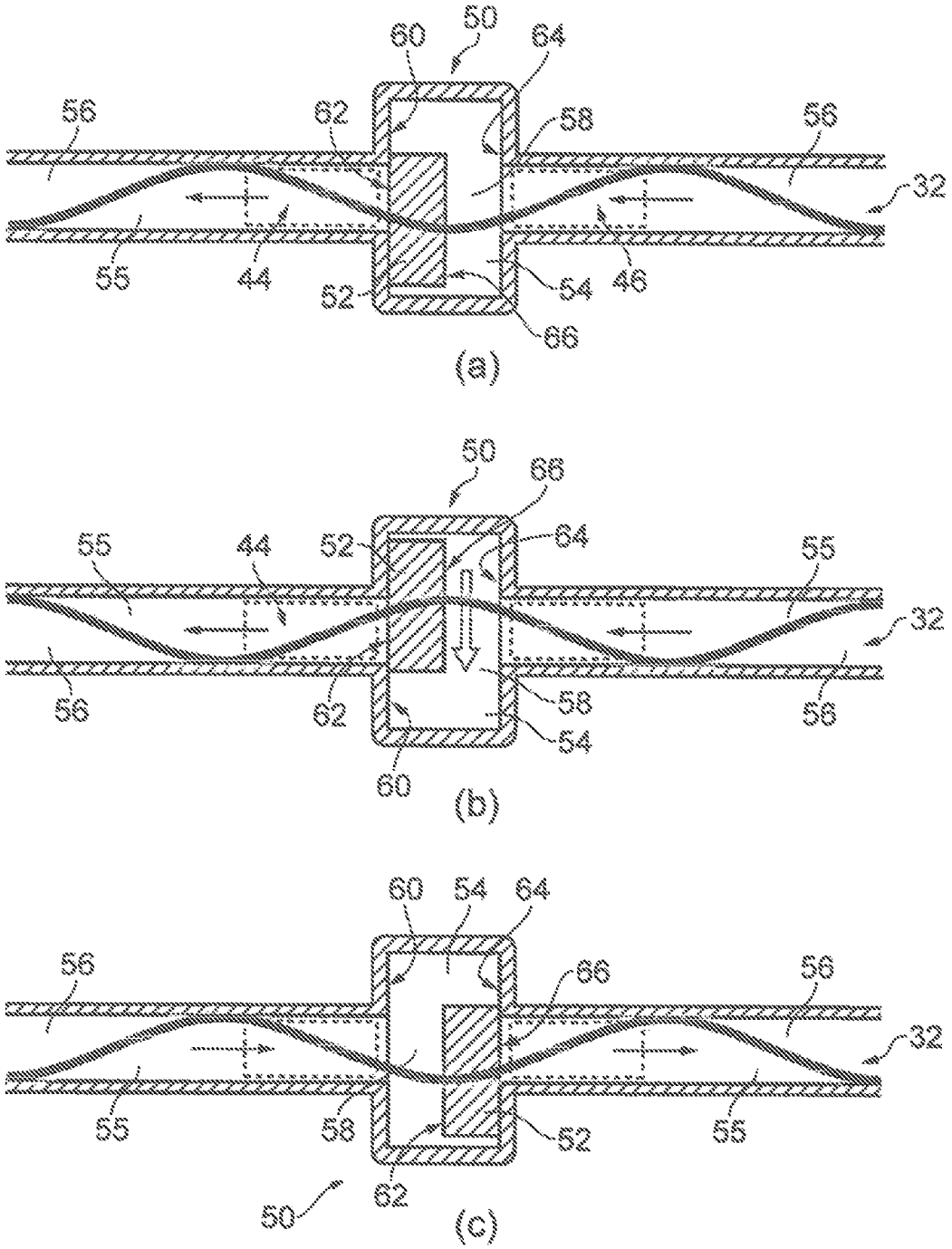
FIG. 4 shows schematic views of the pump duct of a pump according to the invention.

Sub-figures (a) to (c) of FIG. 4 each show a schematic view of the pump duct 32. The pump duct is formed by the pump housing 16 itself, i.e. from the three housing components 18, 20, 22. In this way, installation space can be saved on in the region of the pump duct 32. Furthermore, the assembly and disassembly and also cleaning of the pump 10 are simplified.

The inlet and the outlet of the fluid to be pumped takes place via radially external inlet/outlet spaces 44, 46 which are each shown by way of dashed lines in FIG. 4. In the embodiment shown, the inlet/outlet spaces are formed in a symmetrical manner to one another, in order to allow bidirectional operation of the pump 10.

The pump duct 32 is formed in an annular manner and extends with a constant cross section from the first radially external inlet/outlet space 44 to the second radially external inlet/outlet space 46. The blocking device 50 is between the two inlet/outlet spaces 44, 46 in the annular pump duct 32 and prevents a backflow of the fluid to be pumped counter to the operating direction of the pump. In the region of the radially external inlet/outlet spaces 44, 46, fluid to be pumped can flow in the radial direction into the fluid chambers 55 formed by the rotor 26 and the pump housing. When the rotor 26 is rotated, the fluid chambers are moved further along the annular pump duct 32, wherein one respective fluid chamber 56 closes and allows fluid transport in the pumping direction. On the outlet side of the pump 10, the fluid chambers move into the region of the blocking device 50, which blocks the pump duct 32, with the result that the fluid to be pumped flows in the radial direction out of the fluid chambers and into the outlet-side radially external inlet/outlet space.

The pump 10 is therefore a positive displacement pump which transports a trapped fixed volume in the closed fluid chamber 56.

The function of the blocking device 50 is explained in the following text. The blocking device 50 is arranged between the first inlet/outlet space 44 and the second inlet/outlet space 46 and comprises the blocking element 52, which blocks the pump duct 32 in the axial direction on both sides of the rotor collar 30.

The blocking device 50 is configured for bidirectional operation of the pump 10. To this end, the blocking device 50 has a first seat 60 for the blocking element 52 on the side of the first inlet/outlet space 44, against which the blocking element abuts by way of a first contacting face 62 in a first operating direction for pumping from the first inlet/outlet space 44 to the second inlet/outlet space 46, see FIGS. 4 (*a*) and (*b*).

The blocking device also has a second seat 64 for the blocking element 52 on the side of the second inlet/outlet space 46, against which the blocking element 52 abuts by way of a second contacting face in a second operating direction for pumping from the second inlet/outlet space 46 to the first inlet/outlet space, see FIG. 4 (*c*).

The spacing between the first seat 60 and the second seat 64 in the circumferential direction is greater than the spacing between the first contacting face 62 and the second contacting face 66 in the circumferential direction.

When the operating direction of the bidirectional pump 10 is changed, the blocking element 52 moves from the first seat 60 to the second seat 64 such that the blocking element 52 abuts against a seat 60, 64 in each case by way of one contacting face 62, 66 and the respectively other contacting face 66, 62 is spaced apart from the pump housing 16. Thus, low-friction movement of the blocking element 52 is allowed. Furthermore, the resistance in the fluid to be pumped is reduced and thus the pressure force from the blocking element to the rotor is reduced, with the result that the frictional forces and thus also the wear to the blocking element 52 are reduced.

As can clearly be seen in FIGS. 4 (*a*) and (*b*), the volume in chamber 54 changes when the rotor 26 is rotated (from right to left in the drawing) on account of the undulating shape of the rotor collar and the blocking element 52 moving in the axial direction. Since the blocking device 50 is arranged between the two inlet/outlet spaces 44, 46, it is at least sometimes possible for an axial portion of the chamber 54 of the blocking device 50 not to be connected to the associated outlet space 44, 46.

In order to allow this change in volume to be compensated, an exchange duct 58 is formed between the axially front fluid chamber and the axially rear fluid chamber. A fluid flow is shown in the axial direction by the arrow in FIG. 4 (*b*).

Figure 5:
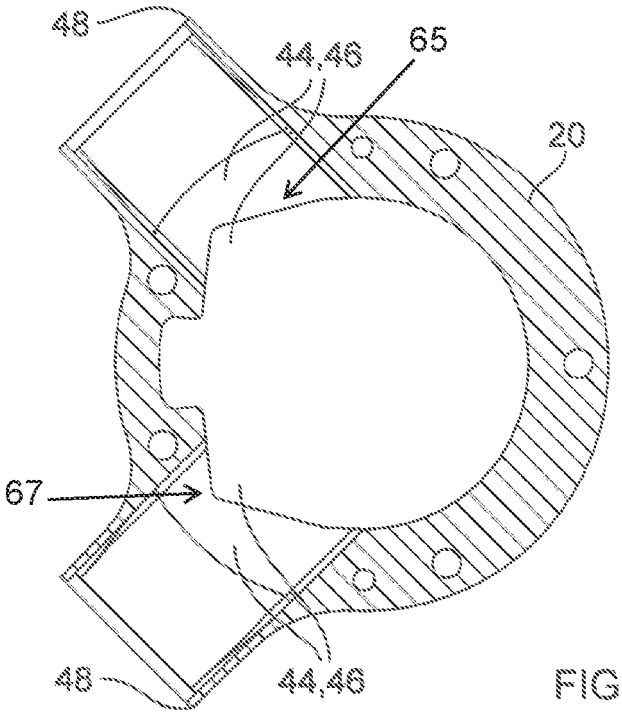
FIG. 5 shows a sectional view of the central housing component according to the embodiment in FIG. 3 on the section plane V-V.

FIG. 5 shows a sectional view through the central housing component 20 in accordance with the section plane V-V in FIG. 3. The housing component 20 is arranged such that the blocking device 50 with the chamber 54 is arranged in a manner rotated by 90° compared with the embodiment shown in FIG. 3, i.e. on the horizontal central axis of the annular pump duct 32. Preferably, the pump 10 is formed such that the pump housing 16 can be attached to the shaft mounting unit 12 at different angles.

The inlet/outlet spaces 44, 46 are formed radially externally on the annular pump duct 32, wherein a first part of the inlet/outlet spaces 44, 46 is formed over the entire axial height of the pump duct in that the central housing component 20 is spaced apart from the pump duct 32 in the radial direction in the region of the inlet/outlet spaces 44, 46. In the embodiment shown, the radial spacing of the housing component 20 narrows 65 in the circumferential direction in the respective end region of the inlet/outlet spaces 44, 46, such that the first part of the inlet/outlet spaces 44, 46 is approximately triangular 67 in axial view. A second part of the inlet/outlet spaces 44, 46 is formed in the housing component 20 and forms a transition to the connection elements 48.

The inlet/outlet spaces 44, 46 are formed in the left-hand upper quadrant and in the left-hand lower quadrant in the housing component 20 in the embodiment shown and each extend as far as the vertical central axis of the annular pump duct 32. This allows the emptying of residues from the pump.

Figure 6:
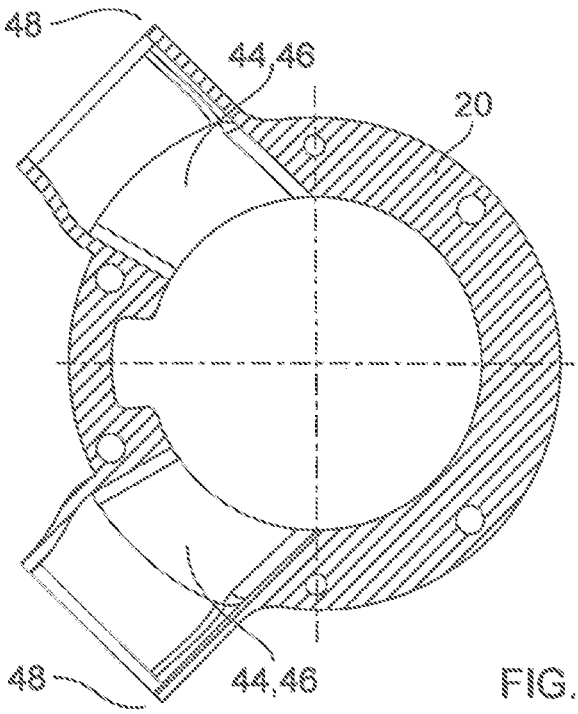
FIG. 6 shows a sectional view of the central housing component according to an alternative embodiment of the invention.

FIG. 6 shows a sectional view through the central housing component 20 as per the alternative embodiment. The embodiment differs from the embodiment shown in FIG. 5 in that the housing component 20 is not spaced apart from the pump duct 32 in the radial direction in the region of the inlet/outlet spaces 44, 46.

Figure 7:
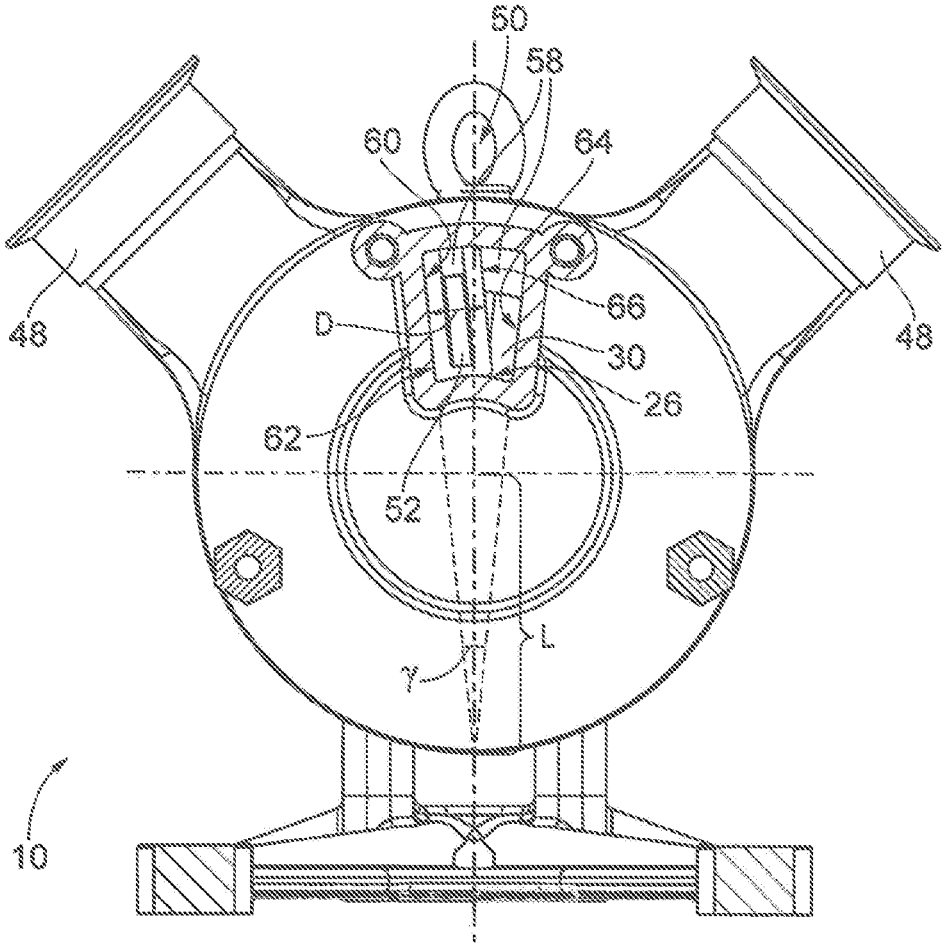
FIG. 7 shows a sectional view of the pump from FIG. 3 on the section plane VII-VII.

FIG. 7 shows a sectional view of the pump from FIG. 3 on the section plane VII-VII through the chamber 54 of the blocking device. The chamber 54 has four inner walls.

A radially internal wall of the chamber 54 is formed in the shape of a circular arc about the rotation axis of the rotor 26 axially on both sides of the rotor 26 and has the same radius as or a slightly smaller radius than the rotor hub 28 in order to ensure a good fit of the blocking element 52 on the rotor hub 28.

A radially external wall of the chamber 54 has a profile that is for example in the shape of a circular arc about the rotation axis of the rotor 26. It is also possible for the radially external wall of the chamber 54 to have some other profile and to be formed for example such that it is spaced apart from the blocking element 52, such that the fluid to be pumped on the pressure side can pass between the radially external wall of the chamber 54 and the blocking element 52 and thus presses the blocking element 52 against the rotor hub 26.

In the circumferential direction, the chamber 54 is formed by two flat walls that are located in the circumferential direction and each surround the flow duct in a U-shaped manner and form the first and second seats 60, 64 for the blocking element 52.

In the embodiment shown, the blocking element 52 is formed with contacting faces 62, 66 that extend in a parallel manner and are spaced apart from one another by a thickness D of the blocking element 52. The two flat walls that are located in the circumferential direction are formed in this embodiment such that the blocking element 52 can be displaced through an angle $\gamma$ in the circumferential direction within the chamber 54 between the first and second seats 60, 64. In the embodiment shown, the angle $\gamma$ is about 10°. The angle $\gamma$ can be in a range from 5° to 40°, wherein the angle is preferably in a range from 5° to 20°.

To this end, the two flat walls that are located in the circumferential direction are in the radial direction with respect to a center point which is shifted on a central axis of the pump by the distance L, wherein $L=(D/2)/\sin(\gamma/2)$. In this way, the centerline of the blocking element 52 is in each case oriented in the radial direction with respect to the rotation axis A when the blocking element abuts respectively against the first or second seat 60, 64 by way of its contacting faces 62, 66. The first and second seats are thus each formed in planes which are oriented at the angle $\gamma$ to one another.

Alternatively, it is possible for the blocking element 52 to be formed such that the first and second contacting faces 62, 66 are arranged at an angle and each extend in the radial direction of the rotor 26. In this case, the two flat walls of the chamber 54 that are located in the circumferential direction are likewise arranged in the radial direction of the rotor 26. The first and second seats are thus each formed in planes which are oriented at the angle $\gamma$ to one another.

It is also possible for the two walls that are located in the circumferential direction and the contacting faces 62, 66 of the blocking element 52 to have a generally cylindrical shape, in particular a curved shape, coordinated with one another.

The shapes of the two walls that are located in the circumferential direction and of the contacting faces 62, 66 of the blocking element 52 can be selected such that the blocking element is pressed against the rotor hub 26 by the pressure difference when the pump is in operation, for example by a wedge shape or arcuate shape of the blocking element 52.

In order to compensate for a change in volume on account of the axial movement of the rotor collar 30 and of the blocking element 52, two exchange ducts 58 are formed in the blocking device 50. These allow a flow of fluid to be pumped between the axially front fluid chamber and the axially rear fluid chamber within the blocking device. This allows a compact configuration of the blocking device 50, since the chamber 54 of the blocking device does not have to be connected to one of the inlet/outlet spaces 44, 46.

In the chamber 54, the ratio of the area of the axial flow cross section of the exchange ducts 58 to the axial projection area of the rotor collar 30 and of that part of the blocking element 52 that projects beyond the rotor collar is preferably at least 0.2 and is preferably in the range from 0.2 to 0.6. This allows sufficient volume compensation with a compact construction of the blocking device 50.

Figure 8:
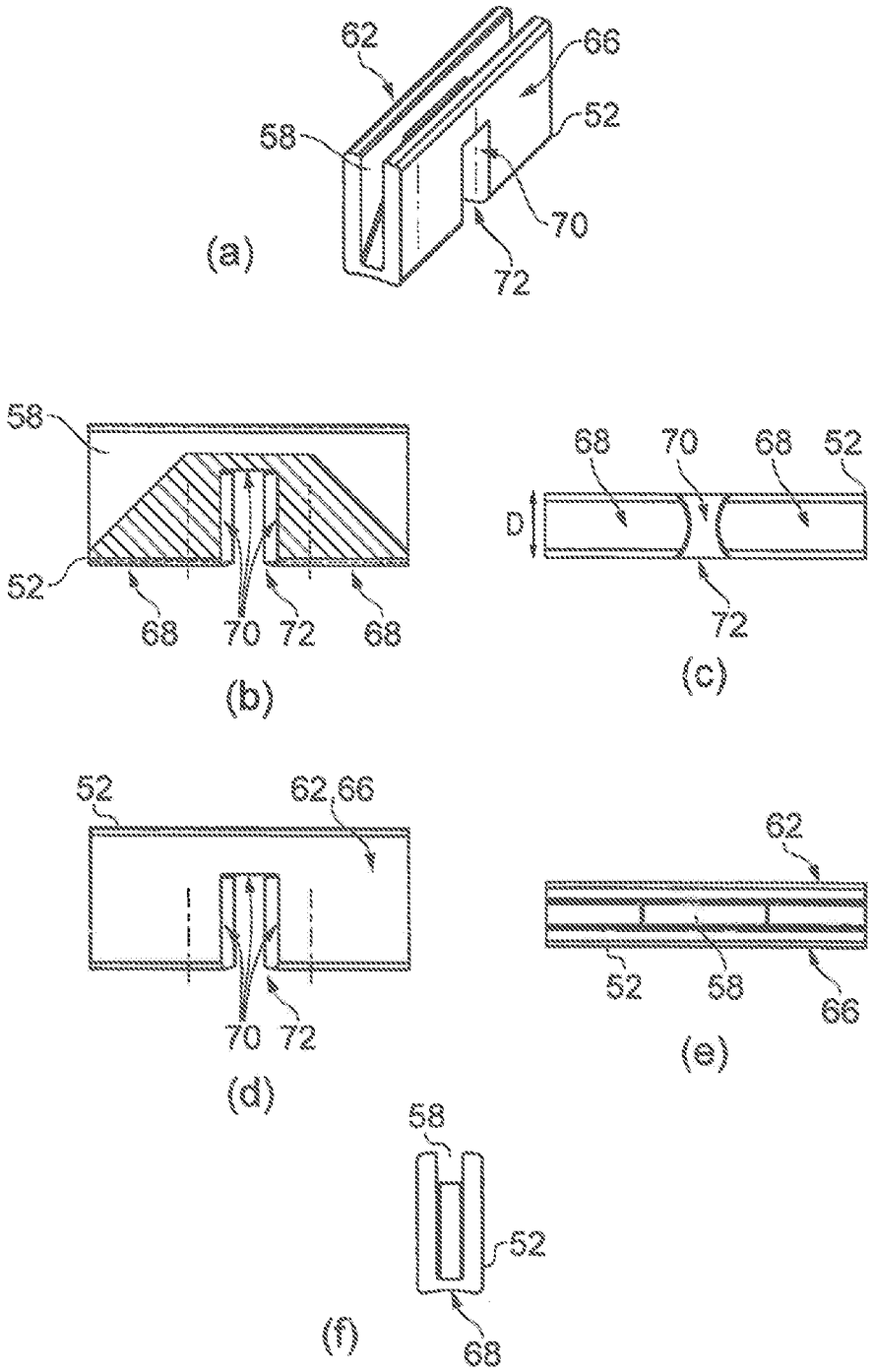
FIG. 8 shows detail views of a blocking element of the pump from FIG. 1.

Sub-figures (a) to (f) of FIG. 8 show various detail views of the blocking element 52 from the embodiment shown in FIG. 7. Sub-figure (a) shows a perspective view of the blocking element 52. Sub-figure (b) shows a sectional view on the central plane. Sub-figure (c) shows a view in the radial direction from the rotor hub 26 outwards. Sub-figure (d) shows a view in the circumferential direction with a contacting face 62, 66. Sub-figure (e) shows a view in the radial direction inwards towards the rotor hub 26 and sub-figure (f) shows a view of the blocking element 52 in the axial direction.

The blocking element 52 is formed in a mirror-symmetrical manner in the central plane extending in the axial direction and radial direction. As a result of the symmetrical configuration of the blocking element 52, it is not necessary to respect a particular orientation of the blocking element when the pump is assembled, and as a result the assembly of the pump can be simplified and malfunctions avoided.

In addition to the first and second contacting faces 62, 66 for abutting against the first and second seats 60, 64 formed in the pump housing 16, the blocking element 52 has two radially internal rotor-hub contacting faces 68 and rotor-collar sealing faces 70, which are each arranged on both sides of a slot 72 for receiving the rotor collar 30 and by way of which the blocking element 52 abuts against the rotor hub 28 and the rotor collar 30 in a sealing manner.

The exchange duct 58 is formed between the first contacting face 62 and the second contacting face 66. In the embodiment shown, the exchange duct 58 of the blocking element 52 is configured as a groove which extends in the axial direction along the entire blocking element 52 on that side of the blocking element that is remote from the rotor hub. In order to improve a flow of the fluid to be pumped through the exchange duct 58, the groove extends approximately over the entire height of the blocking element at the two axial ends and narrows towards the central region of the blocking element, in which the slot 72 is arranged.

Figure 9:
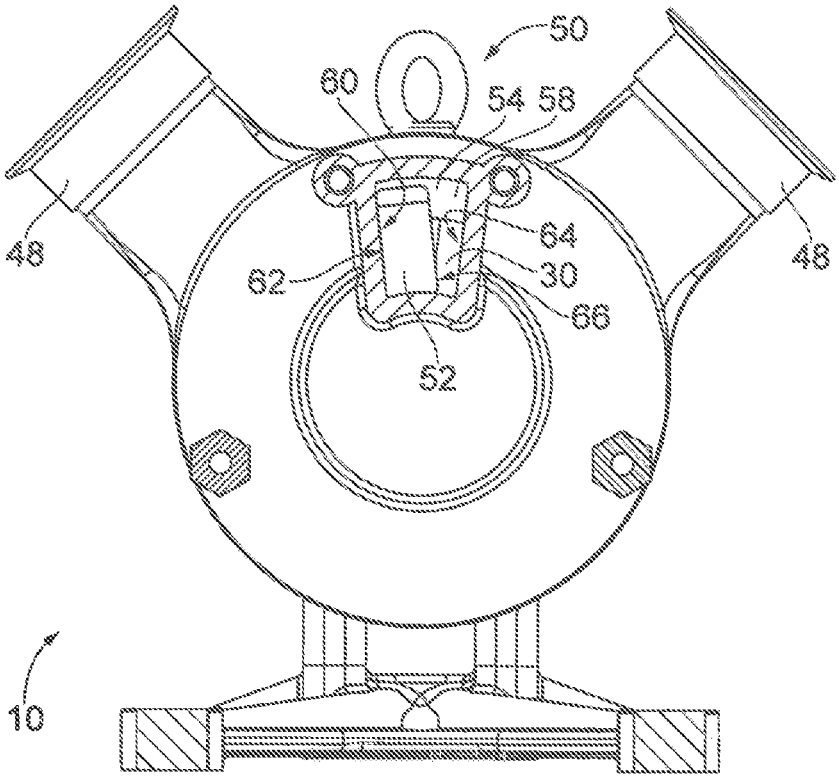
FIG. 9 shows a sectional view of the pump from FIG. 3 on the section plane VII-VII with a blocking element according to a second embodiment.

FIG. 9 shows a second embodiment of the invention, wherein the pump 10 differs from the first embodiment shown in FIG. 7 only by way of the blocking element 52. The blocking element 52 is formed without the central groove. In this embodiment, the blocking element 52 is spaced apart from the radially outer wall in the chamber 54, such that the fluid to be pumped presses the blocking element 52 against the rotor hub 28. Analogously to the first embodiment, the blocking element of the second embodiment can also have a different geometry.

Figure 10:
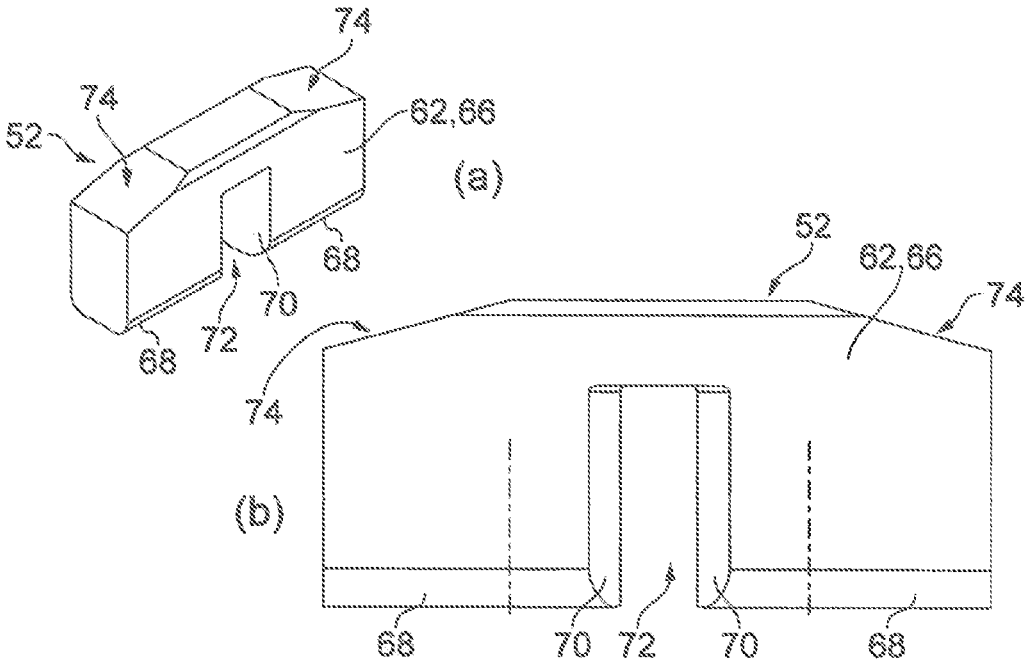
FIG. 10 shows detail views of the blocking element of the pump from FIG. 9.

FIG. 10 shows the blocking element of the second embodiment, wherein sub-figure (a) shows a perspective view of the blocking element 52 and sub-figure (b) shows a side view of the blocking element 52. Analogously to the blocking element from FIG. 8, the blocking element 52 has a first and a second contacting face 62, 66 for abutting against the first and second seats 60, 64 formed in the pump housing 16, and two radially internal rotor-hub contacting faces 68 and rotor-collar sealing faces 70, which are each arranged on both sides of a slot 72 for receiving the rotor collar 30 and by way of which the blocking element 52 abuts against the rotor hub 28 and the rotor collar 30 in a sealing manner.

On the radial outer side of the blocking element 52, the blocking element 52 has two inclined faces 74. In the event of a movement in the axial direction, the blocking element 52 is pressed against the rotor hub 28 by the inclined faces 74 and the resistance of the fluid to be pumped.

Figure 11:
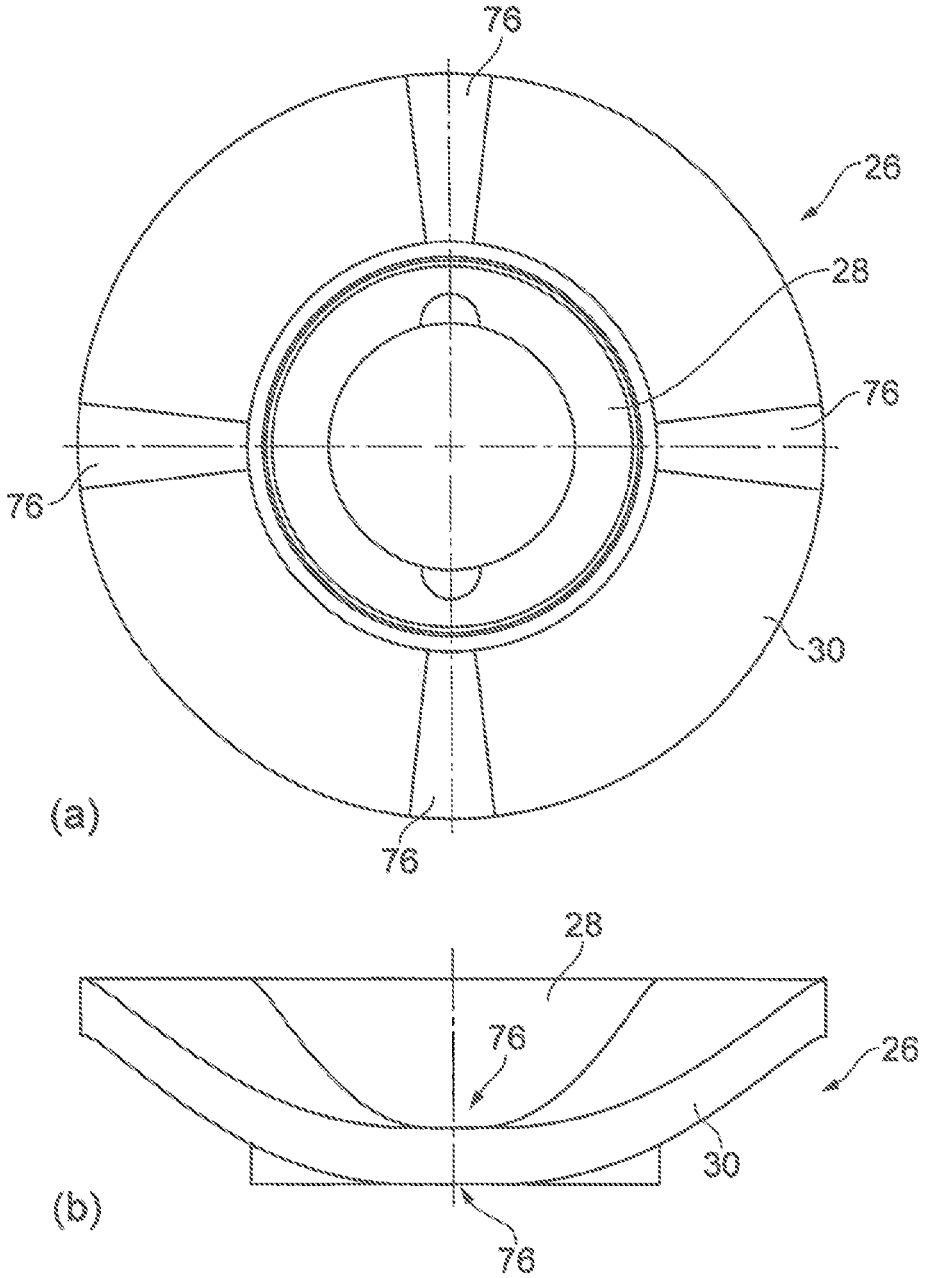
FIG. 11 shows detail views of a rotor of the pump from FIG. 1.

Sub-figures (a) and (b) of FIG. 11 each show a view of the rotor 26, wherein sub-figure (a) shows an axial plan view of the rotor 26 and sub-figure (b) shows a radial plan view of the rotor 26.

The rotor collar 30 extends in the radial direction from the rotor hub 28 and encircles the rotor hub 28 in an undulating manner. In the embodiment shown, the rotor collar 30 is in the two axial extreme positions at two opposite points each. Thus, the rotor collar forms two fluid chambers on each of the two axial sides of the rotor collar.

In the embodiment shown, the rotor collar 30 extends in a flattened manner at the axial extreme positions 76, with the result that the sealing is improved at the axial end faces of the pump duct 32, which are formed by the two axial housing components 18 and 22. This allows in particular an enlargement of a gap between the rotor collar 30 and the axial end faces of the pump duct 32. This allows the pump to generate greater pressures with larger gap dimensions.

In the embodiment shown, the rotor 26 is produced from an anti-seizure alloy.

Preferably, a sealing face, in the form of a circumferential groove, for a mechanical face seal is provided in the rotor hub 26.

It is also possible for other rotor shapes to be used for the pump.

In the embodiment shown, the pump 10 is formed with a blocking device 50 which allows the pump 10 to be operated on both sides. However, some other blocking device 50 which allows the pump to be operated for example on one side can also be provided.

The invention claimed is:

1. A pump comprising:

a rotor rotatable about a rotation axis and comprising a rotor hub and a rotor collar, the rotor collar extending from the rotor hub in a radial direction and encircling the rotor hub in an undulating manner; and a pump housing comprising a first axial housing component, a central annular housing component, and a second axial housing component, wherein an annular pump duct is formed (i) in an axial direction by the first and second axial housing components and (ii) in the radial direction by the central annular housing component and the rotor; and wherein the central annular housing component is spaced from the annular pump duct in the radial direction to form inlet/outlet spaces radially spaced outside the annular pump duct and extending over an entire axial height of the annular pump duct, and wherein a radial spacing of the central annular housing component narrows in a circumferential direction in a respective end region of the inlet/outlet spaces, such that an edge portion of the inlet/outlet spaces that abuts the annular pump duct forms a portion of a triangular shape in an axial view.

2. The pump according to claim 1, wherein the annular pump duct has a constant cross section and connects a first radially external inlet/outlet space to a second radially external inlet/outlet space, the pump further comprising a blocking device arranged between the first radially external inlet/outlet space and the second radially external inlet/outlet space and comprising a blocking element blocking the annular pump duct in the axial direction on both sides of the rotor collar.

3. The pump according to claim 2, wherein the pump housing forms a seat for the blocking element of the blocking device.

4. The pump according to claim 3, wherein the seat for the blocking element is formed in a chamber of the pump housing, wherein the chamber is formed in a sector of the annular pump duct and extends on both sides in the axial direction and outwards beyond a cross section of the annular pump duct in the radial direction.

5. The pump according to claim 1, wherein the rotor collar has flat end faces in axial end positions.

6. The pump according to claim 1, wherein the rotor and the pump housing are made of metal.

7. The pump according to claim 1, wherein at least one of the rotor and the pump housing is made of an anti-seizure alloy.

8. The pump according to claim 1, wherein a connection from the annular pump duct to first and second radially external inlet/outlet spaces has a rectangular cross section.

9. The pump according to claim 1, further including a shaft fastened to the rotor, wherein the shaft has a one sided support.

10. A pump comprising:

a rotor rotatable about a rotation axis and comprising a rotor hub and a rotor collar, the rotor collar extending from the rotor hub in a radial direction and encircling the rotor hub in an undulating manner;

a pump housing including a central annular housing component forming an annular pump duct with the rotor, said annular pump duct having a constant cross section and connecting a first radially external inlet/outlet space to a second radially external inlet/outlet space; and a blocking device arranged between the first radially external inlet/outlet space and the second radially external inlet/outlet space, the blocking device comprising a blocking element blocking the annular pump duct in an axial direction on both sides of the rotor collar, wherein the first and second radially external inlet/outlet spaces are formed over an entire axial height of the annular pump duct, and wherein a radial spacing of the central annular housing component narrows in a circumferential direction in a respective end region of the first and second radially external inlet/outlet spaces, such that an edge portion of the first and second radially external inlet/outlet spaces that abuts the annular pump duct forms a portion of a triangular shape in an axial view.

11. The pump according to claim 10, wherein the pump housing comprises a first axial housing component; and a second axial housing component, and wherein the annular pump duct is formed (i) in the axial direction by the first and second axial housing components and (ii) in the radial direction by the central annular housing component and the rotor.

12. The pump according to claim 10, wherein the pump housing forms a seat for the blocking element of the blocking device.

13. The pump according to claim 12, wherein the seat for the blocking element is formed in a chamber of the pump housing, and wherein the chamber is formed in a sector of the annular pump duct and extends on both sides in the axial direction and outwards beyond a cross section of the annular pump duct in the radial direction.

14. The pump according to claim 10, wherein the rotor collar has flat end faces in axial end positions.

15. The pump according to claim 10, wherein the rotor and the pump housing are made of metal.

16. The pump according to claim 10, wherein at least one of the rotor and the pump housing is made of an anti-seizure alloy.

17. The pump according to claim 10, wherein the connection from the annular pump duct to the first and second radially external inlet/outlet spaces has a rectangular cross section.

18. The pump according to claim 10, further including a shaft fastened to the rotor, wherein the shaft has a one sided support.

* * * * *